United States Patent [19]

Merl

[11] Patent Number: 4,787,687

[45] Date of Patent: Nov. 29, 1988

[54] NEWSPAPER VENDING BIN

[75] Inventor: Milton J. Merl, New City, N.Y.

[73] Assignee: Gannett Co., Inc., Arlington, Va.

[21] Appl. No.: 85,417

[22] Filed: Aug. 14, 1987

[51] Int. Cl.[4] ..... A47B 81/00

[52] U.S. Cl. ..... 312/100; 40/605; 40/611; 312/111; 312/234

[58] Field of Search ..... 312/100, 108, 111, 257 R, 312/234, 140; 211/194; 220/4 C; 206/821; 40/611, 607, 606, 489, 490, 605

[56] References Cited

U.S. PATENT DOCUMENTS

| | | | |
|---|---|---|---|
| D. 213,532 | 3/1969 | Yeo . | |
| D. 214,947 | 8/1969 | Perkins . | |
| D. 219,479 | 12/1970 | Perkins . | |
| D. 273,019 | 3/1984 | Chalabian . | |
| D. 273,020 | 3/1984 | Chalabian . | |
| D. 273,021 | 3/1984 | Chalabian . | |
| D. 273,022 | 3/1984 | Chalabian . | |
| D. 273,023 | 3/1984 | Chalabian . | |
| D. 273,123 | 3/1984 | Gore . | |
| D. 273,203 | 3/1984 | Gore . | |
| D. 273,595 | 4/1984 | Gore . | |
| D. 273,686 | 5/1984 | Gore . | |
| 1,281,619 | 10/1918 | McKay | 220/4 R |
| 2,575,919 | 11/1951 | Kautzmann | 208/821 X |
| 2,678,707 | 5/1954 | Finkelstein | 40/611 X |
| 3,329,473 | 7/1967 | Dickson | 312/111 X |
| 4,194,453 | 3/1980 | Cutter | 312/111 X |
| 4,285,559 | 8/1981 | Koch | 312/111 X |
| 4,426,800 | 1/1984 | Brown | 40/611 X |
| 4,544,081 | 10/1985 | Voegeli . | |
| 4,707,038 | 11/1987 | Voegeli | 312/257 R X |

*Primary Examiner*—Joseph Falk

*Attorney, Agent, or Firm*—Cushman, Darby & Cushman

[57] ABSTRACT

A mechanical device for displaying newspapers for self-service free access by prospective readers is provided in modular form, which in one preferred embodiment may sufficiently resemble the newsrack from which USA TODAY newspapers are vended as to cause prospective newspaper readers to make the connection. In the preferred embodiment the construction is modular, including at least one open-front, open-top box body-like bin with an interior back panel. The bin may be mounted on a pedestal or on a countertop, or it may be hung from a wall. Other similar bins may be stacked on the first and connected with it. A header panel, upstanding at the top rear of the uppermost bin may be used for a display copy of the paper. The bins preferably are molded of structural framed plastic resin.

12 Claims, 7 Drawing Sheets

Fig. 5A
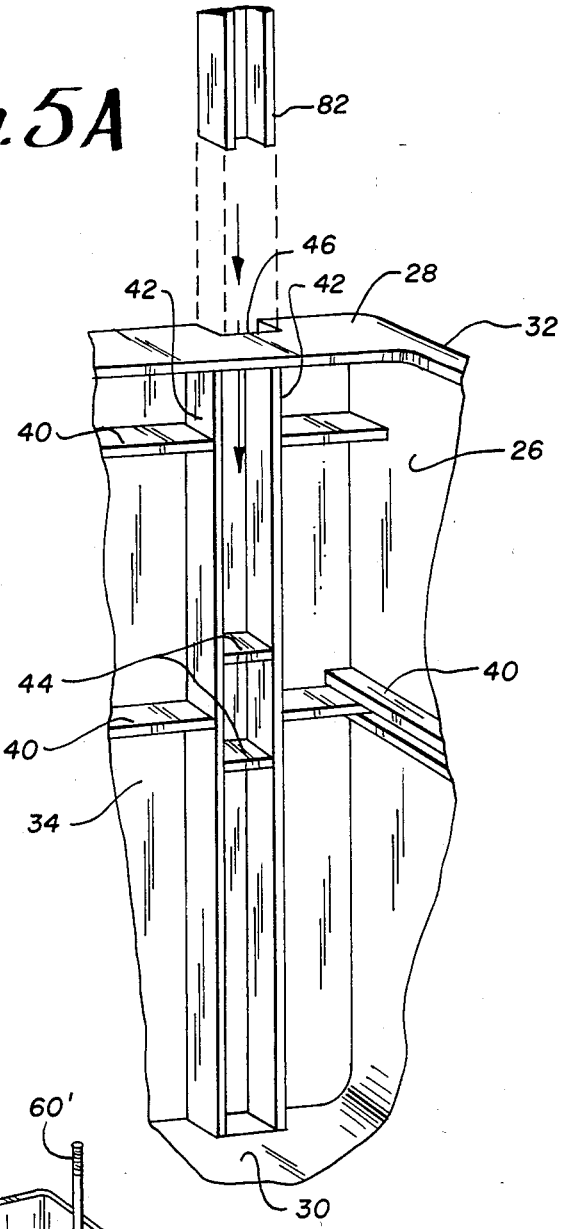
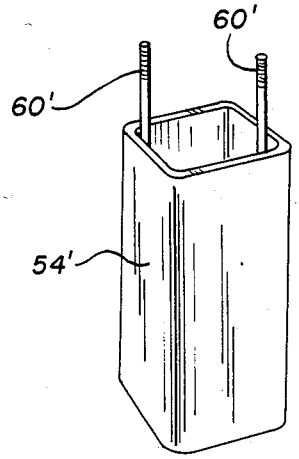
Fig. 6
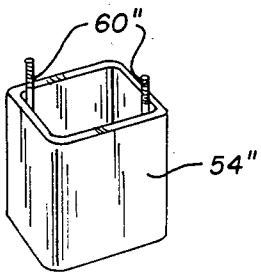
Fig. 7

NEWSPAPER VENDING BIN

BACKGROUND OF THE INVENTION

Mechanical devices for vending newspapers are principally divided into two categories, namely coin-operated vendors which combine a system for displaying a newspaper, and storing a stock of copies with a system for accepting payment and controlling access to the stock in relation to receipt of payment, and point of sale displays which have the displaying and storing system, but not the payment acceptance and access-controlling system. Mechanical devices of the point of sale type often are used in magazine/newspaper vending stalls or areas in hotel lobbies, airport terminals, coffee shops and similar locations. The present invention principally relates to devices in the latter category.

The term "point of sale" is used loosely herein, to cover not only instances where a potential reader will pick up a newspaper and pay for it at an adjacent check-out register, sales counter, honor-system coin-box or the like, but also instances in which a hotel, airline or the like has bought a supply of copies of the newspaper in bulk and distributes them on a self-service basis or by means of an hospitality-giver who stands by the display and hands copies to passing guests, patrons, ticketholders and the like, without payment being expected from the recipients. Similarly, the term "self-service display" is used loosely herein to denote the same type of mechanical device, regardless of whether the environmental set-up is such that the potential reader actually takes the newspaper from the device himself or herself, or has it handed to him or to her by someone else, such as a hospitality-giver who has taken it from the device. And likewise, the term vendor is used without regard to whether payment is made by or expected of the persons who received individual copies of the newspaper from the device.

The newspaper USA TODAY is vended from a now-familar and distinctive coin-operated vendor which has a pedestal-mounted box with a round-cornered wrapper and a front panel assembly which both displays the front page of an issue of the paper behind a transparent panel of an access-controlled door, and a coin-accepting mechanism which controls access to the door. The distinctiveness of the coin-operated USA TODAY newspaper rack is enhanced by a distinctive color scheme and logography for the box. Examples of the appearance of the coin-operated USA TODAY newspaper rack are shown in the U.S. Pat. No. Des. 273,123 to Gore, issued Mar. 10, 1984 and U.S. Pat. No. 4,544,081, to Voegeli issued Oct. 1, 1985, and in the copending U.S. patent application Ser. No. 921,464 to Nichols, filed Oct. 22, 1986. The first-mentioned patent shows the basic design, the second relates to some mechanical arrangements, e.g. in the mechanical construction of the box body and front panel assembly, and the copending application relates to a version in which the box body is made in one piece out of molded plastic material.

SUMMARY OF THE INVENTION

A mechanical device for displaying newspapers for self-service free access by prospective readers is provided in modular form, which in one preferred embodiment may sufficiently resemble the newsrack from which USA TODAY newspapers are vended as to cause prospective newspaper readers to make the connection. In the preferred embodiment the construction is modular, including at least one open-front, open-top box body-like bin with an interior back panel. The bin may be mounted on a pedestal or on a countertop, or it may be hung from a wall. Other similar bins may be stacked on the first and connected with it. A header panel, upstanding at the top rear of the uppermost bin may be used for a display copy of the paper. The bins preferably are molded of structural framed plastic resin.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 5A is an enlarged fragmentary perspective view showing a detail of the structure which is illustrated in FIG. 5;

FIGS. 6 and 7 are perspective views of the progressively shorter pedestals of the versions of FIGS. 3 and 4;

DETAILED DESCRIPTION

Figure 1:
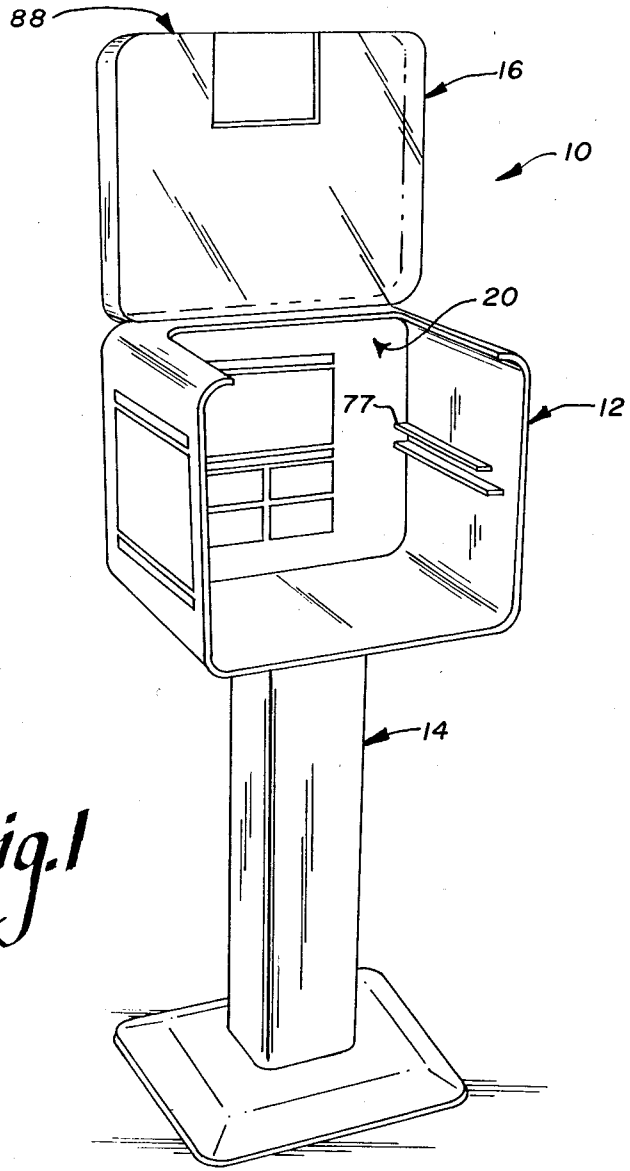
FIG. 1 a perspective view showing a single-bin, pedestal-mounted, header-equipped version of a newspaper vending bin embodying principles of the present invention.
Figure 5:
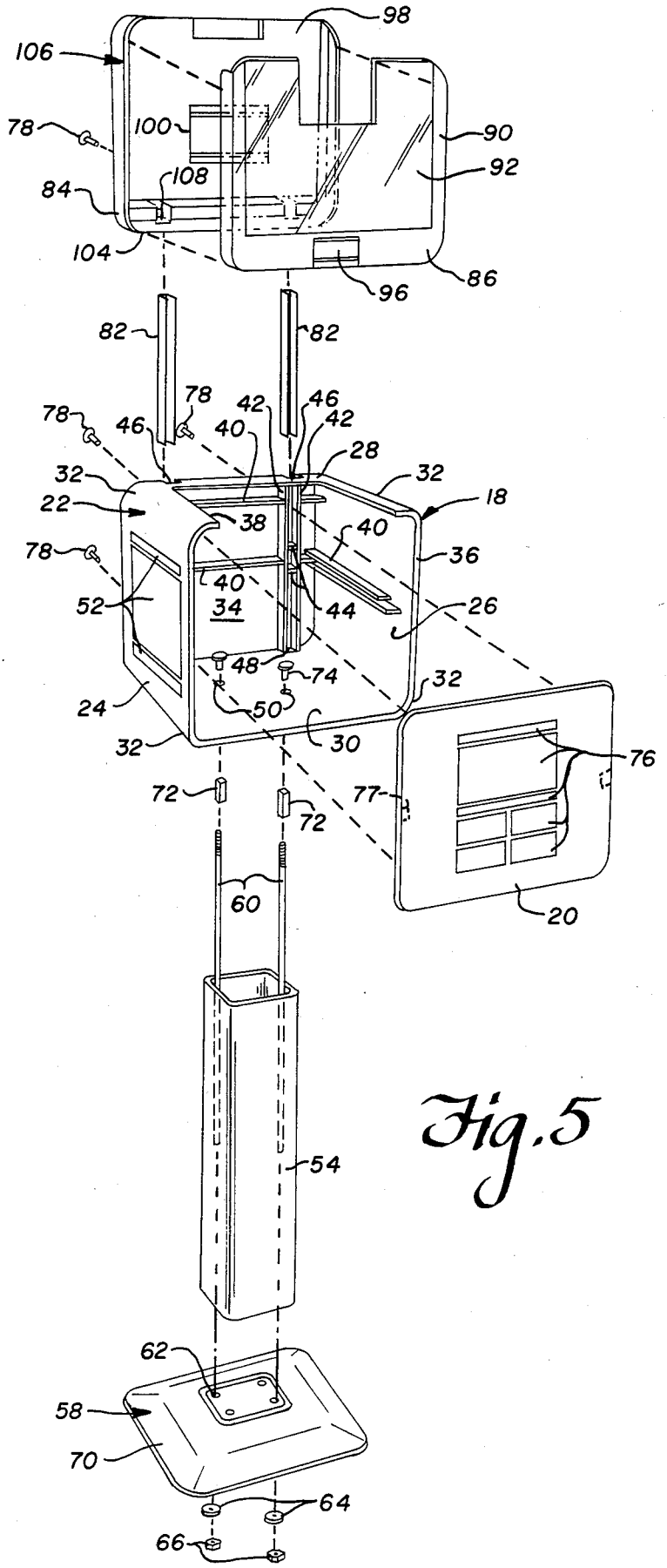
FIG. 5 is an exploded perspective view of the newspaper vending bin of FIG. 1.
Figure 8:
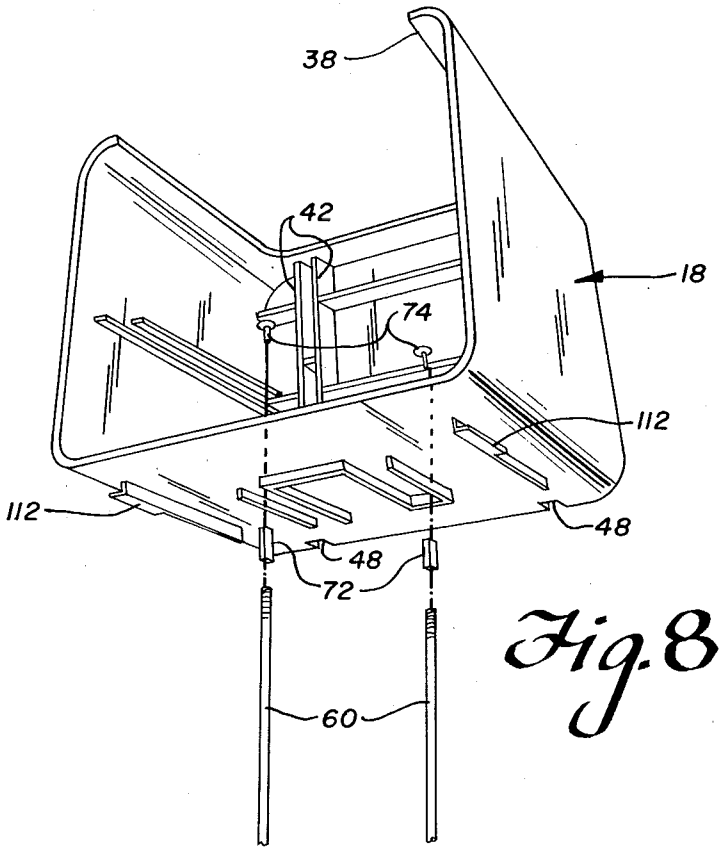
FIGS. 8 and 9 exploded fragmentary perspective views from somewhat below, of the newspaper vending bin of FIG. 5 as the bin is being assembled to a pedestal and pedestal base.
Figure 9:
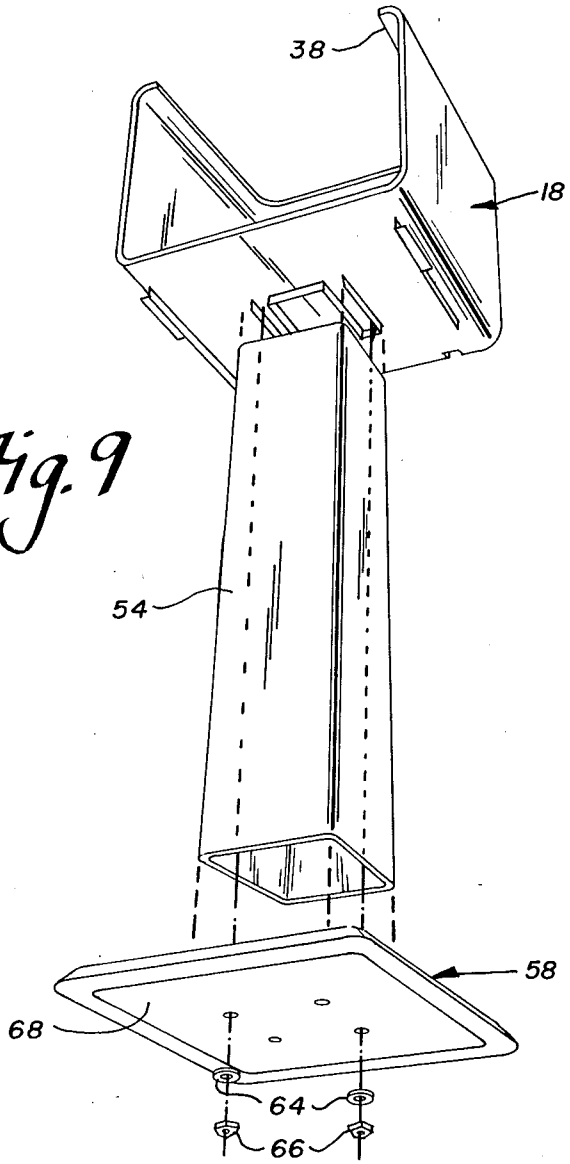
Figure 11:
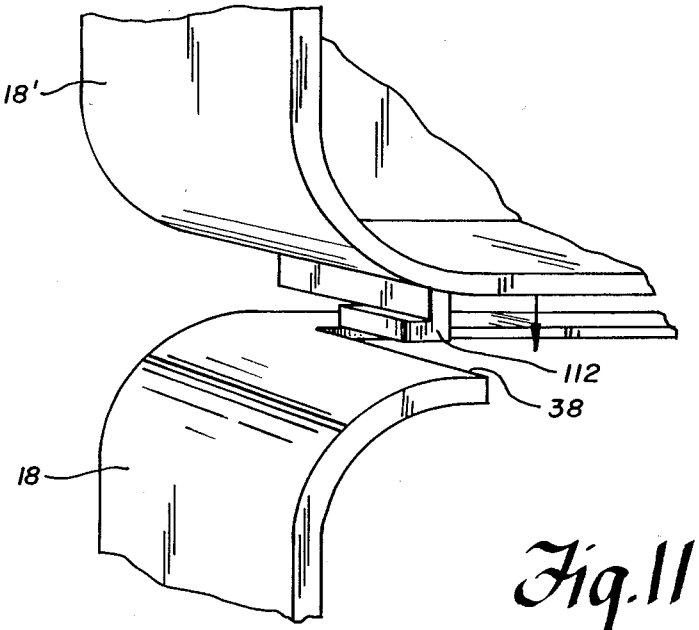
FIG. 11 is a larger scale fragmentary perspective view of the region which is circled in FIG. 10, as the two bins are fitted together.

A version of a mechanical device for displaying newspapers for self-service free access is shown at 10 in FIG. 1, and the same version is shown in an explosed perspective view in FIG. 5 so as to facilitate imparting a clear understanding of how the device is constructed and assembled.

Referring to FIG. 1, the device 10 is shown including a bin 12 mounted on an upright pedestal 14 and mounting a newspaper display header 16.

The pedestal 14 may be identical to the one used for the well-known coin-operated USA TODAY newsrack, the bin 12 includes an integrally-molded body 18, fitted with an inside back panel.

In the preferred embodiments illustrated, the bin body 18 has a rounded-corner outer peripheral wall 22 which includes left and right sidewalls 24, 26 which are substantially vertical, and top and bottom walls 28, 30 which are substantially horizontal. The four rounded corners are shown at 32. (The bin body 18 further includes a back wall, 34 which is obscured in FIG. 1 by the inside back panel 20, but visible in FIG. 5. The rear wall 34 is vertical and its perimeter coincides with the rear edges of the outer peripheral wall 22.) The bin body 18 is completely open at the front, so that its front is provided by the front edge 36 of the outer peripheral wall 22, and it preferably includes a deep, rounded rear corner rectangular notch 38 medially located in the front edge 36 of the top wall 28, so that the top wall is missing except in a forwardly opening U-shaped strip which borders the upper corners 32 and the back wall 34.

Referring temporarily to FIG. 5, one may see that the inner surface of the back wall and the inner surfaces of the left and right sidewalls are integrally provided with a plurality of stiffening ribs 40, including a left and a right pair of laterally spaced, vertical ribs 42, each of which has a pair of vertically spaced stop webs 44 extending between the respective ribs approximately halfway up the back wall 34. The space between each pair of ribs 42 is communicated through the top wall 28 and the bottom wall 30 by respective slots 46, 48, which are shown being of generally square perimeter.

Generally centrally of the bottom wall 30, a pair of openings 50 is provided through the bottom wall at diagonally opposite corners of an imaginary square.

Logography may be provided on various surfaces of the bin body, e.g. on the outside surfaces of the left and right sidewalls as indicated at 52, on the outside (rear) surface of the back wall 34 (not shown), e.g. indicating the logo of the newspaper, e.g. USA TODAY, which is available from the vendor 10.

For assembling the bin 10, the tubular, rounded-corner square-sectioned post 54 of the pedestal has its bottom end socketed in a correspondingly-shaped indentation 56 provided in the base 58. A rib means, for the same purpose is shown integrally provided on the central part of the outside of the bottom wall of the bin body, at 69. Rods 60 are inserted through the post 54, through holes 62 in the base and have washers 64 and hex nuts 66 installed on their lower ends. (The base 58 preferably incorporates a center-of-gravity-lowering metal plate 68 under a covering shroud 70 to which it has been pre-assembled at the factory.) The threaded upper ends of the rods 60 threadedly receive collars 72 which are inserted through the holes 50 in the bottom wall and then receive flat head screws 74, which, when tightened, secure the bin body 18 on the upper end of the post 54 of the pedestal.

Figure 4:
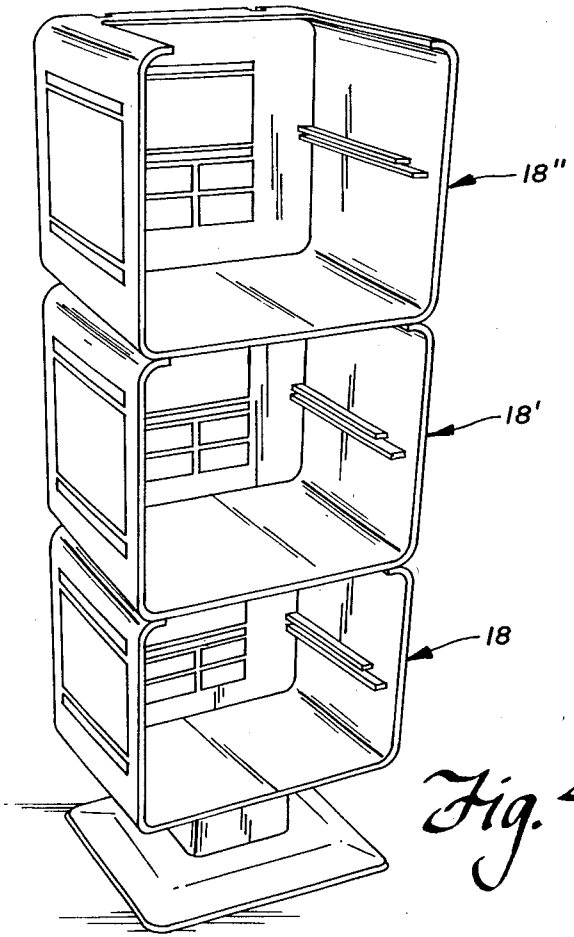
FIG. 4 the version of FIG. 3 a step further, by showing use of three bins in the stack, with the pedestal used being progressively shorter from FIG. 1 to FIG. 3 to FIG. 4 so as to prevent the top bin from being located at so high a level that most people conveniently reach into it for newspapers.
Figure 3:
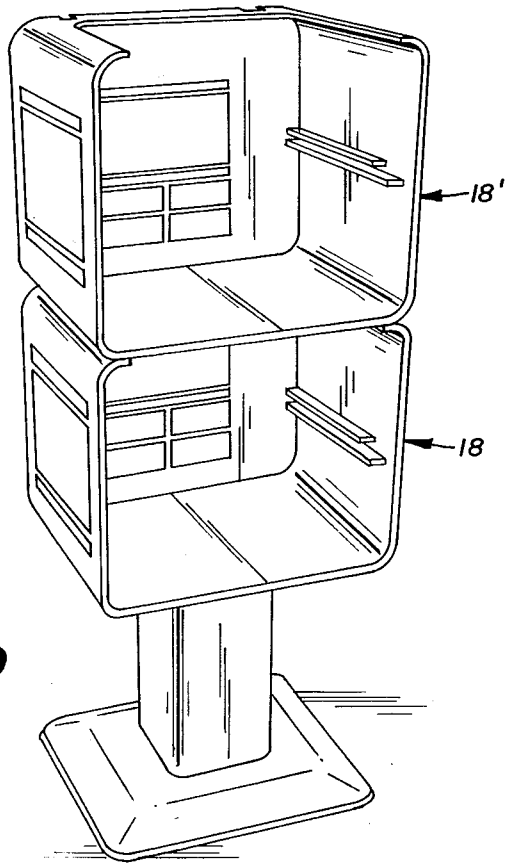
FIG. 3 a version similar to the FIG. 1 version, except that a second bin has been mounted on the first, and the header has been omitted (although it could be mounted on the upper bin in the same manner as the header is provided on the top of the sole bin of the FIG. 1 version)

(For the embodiments of FIGS. 3 and 4, respectively, the rods 60 and posts 54 may be replaced by correspondingly respectively shorter ones 60', 54' and 60", 54" as illustrated in FIGS. 6 and 7.)

The back panel 20 is provided as a facade for the inner side of the back wall. The back panel is, for instance, a rounded-corner rectangular wall, e.g. made of structural foamed plastic resin and provided with logography 76 on its front face, e.g. indicating the newspaper which is to be available from the device 10.

Figure 10:
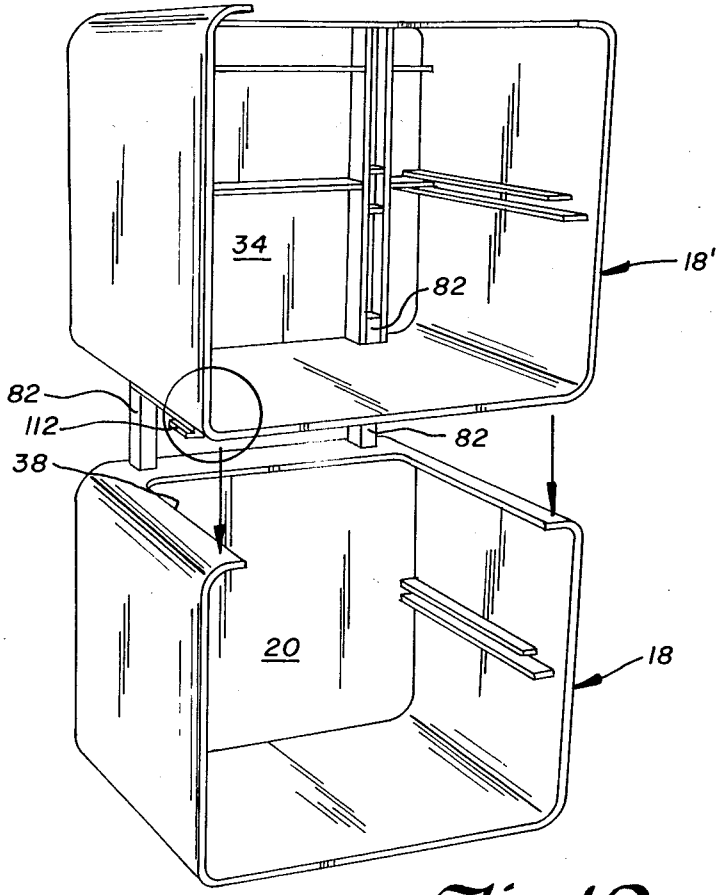
FIG. 10 is a perspective view showing how an upper bin is mounted on a lower bin.

The outer perimeter of the panel preferably matches the perimeter of the back wall 34 inside the bin body, except that notches 77 are cut halfway up in its left and right edges so that the panel 20 can be slid rearwards along the side ribs 40 until its rear surface engages the front edge plane of the ribs 40, 42 on the front surface of the back wall 34. The back panel 34 is held in place by tap screws 78 which are installed through holes 80 in the back wall 34 (between the respective ribs of each pair 42), into the back of the inside back panel 20, as indicated in FIG. 10.

Figure 12:
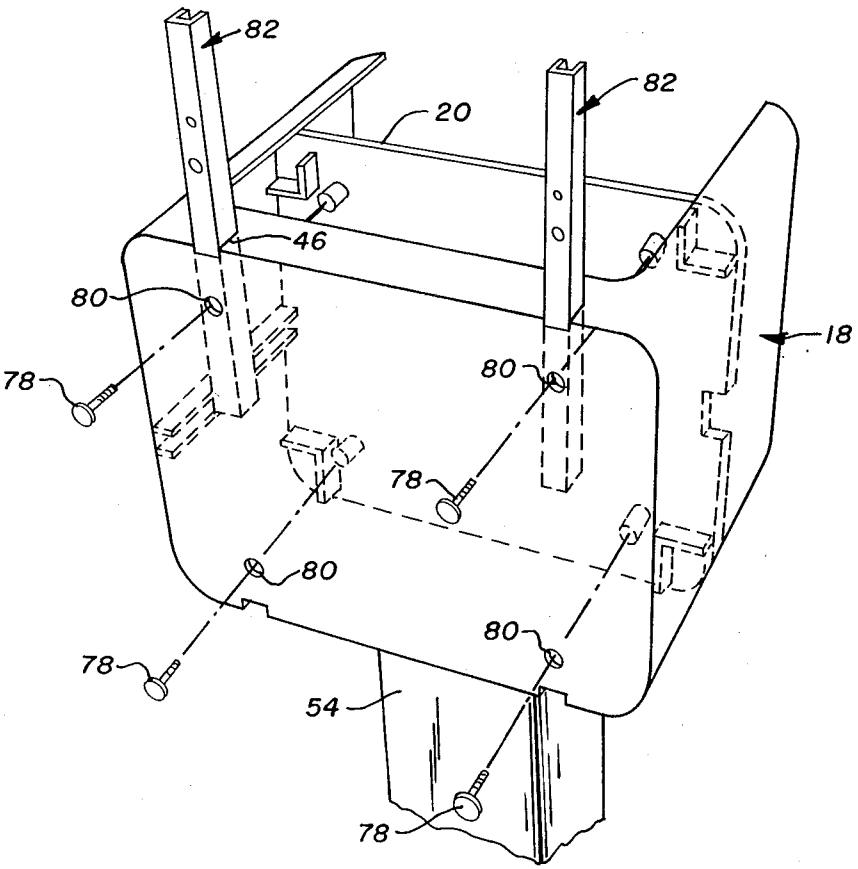

When the top of the bin body 18 is to receive another bin body 18' or a header, a post 82, e.g. made of metal or plastic and of U-shaped transverse cross-section, is slid vertically down through the respective slots 46 in the top wall, between the respective ribs 42 of a respective pair, until they come to rest on the respective webs 44. (The tap screws 78 if installed through the posts, thereby secure the posts in place.) The posts project up out of the slots 46 by a distance equal to about half their respective lengths. See FIG. 12.

The header 16 is in the preferred embodiment a combined attractive sign, and a holder for removably holding a display copy of the newspaper or other publication which is being vended from the device 10.

The frontal profile of the header 16 preferably generally resembles that of the bin body in both size and shape.

The header 16 includes a rear portion 84 and a front portion 86 which fit together much in the manner of the lid and bottom of a take-out box for pizza, except that instead of being hinged together along one wall, that wall (in this instance the top wall) is missing so as to leave an upwardly opening slot 88 into the interior space of the header 16, down through which a display copy of the newspaper or other publication may be slid. The front wall 90 is at least regionally transparent to provide a glazed window 92 through which the front page of the newspaper, above the fold, may be observed. The remainder of the front wall, e.g. in a U-shaped marginal region 94 may be opaque and e.g. provided with logography as at 96. Similarly, the front surface of the back wall 98 of the header may be provided with logography as at 100, so that the display looks inviting even when no display copy of the publication is housed in the interior space of the header. The notch 102 medially provided in the upper edge of the front wall of the header makes it easier to insert and remove the display copy of the publication.

The bottom wall 104 of the peripheral wall 106 of the rear portion 84 of the header has slots 108 through it, through which the upwardly projecting stubs of the posts 82 project. And tap screws 110 may be installed through the back of the rear portion 84, the stubs of the posts 82 and into the back of the front panel (in the opaque area below the window 92), for holding the header together and the header mounted on the bin body.

When the header 16 is completely installed, as shown in FIG. 1, its bottom wall rests on the top wall of the bin body behind the slot in the top wall of the bin body. See FIG. 13.

In use, a stack of newspapers, with their folds forward, is stacked vertically in the internal space of the bin body. Each person who wants a paper can take one from the top of the stack. Periodically the stack can be replenished, and when the supply is exhausted but for the one in the header, the next person can easily take that one. For the next issue of the publication, any remaining papers can be removed from the stack and/or the header and copies of the new edition inserted in their place.

Because so much of the bin body is open at the front and top, it is easy for a person to see the papers there and to reach in and get one.

The header rear portion and the inside back panel 20 likewise are preferably made of structural foam plastic resin, and the header front portion preferably is made of clear synthetic plastic resin which is regionally opaqued, e.g. by screen printing, stencilling, application of decals, or the like. The logography preferably is applied by screen printing, but it may be applied by using decals.

If a second bin body 18' is to be mounted on the first instead of mounting a header on the first one, the procedure is similar to that used for mounting the header on the lower bin body, as described above, the post stubs being inserted through the slots 48, and securement effected by the tap screws which hold the inside back panel of the upper bin body 18' in place. A version resulting from such an assembly is shown in FIG. 3. Although no header is shown mounted on the upper bin body 18, in FIG. 3, in any of the embodiments a header can be mounted on the uppermost bin body using the same manner of installation as was described above in relation to FIGS. 1 and 5. See FIG. 10.

Figure 13:
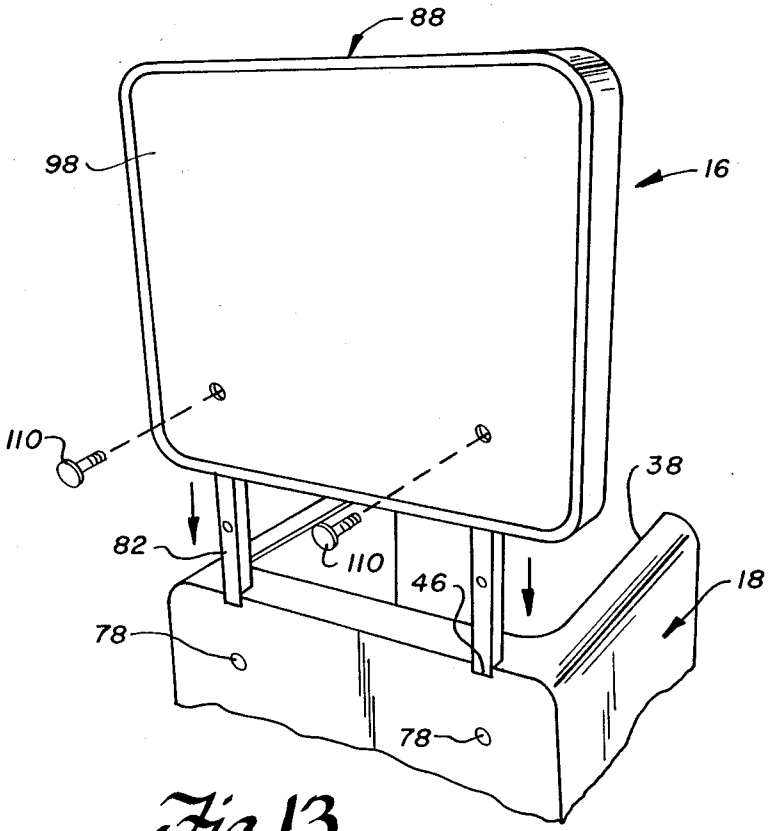
FIGS. 12 and 13 are fragmentary perspective views from the rear, showing how upright posts are installed either for mounting an upper bin on a lower bin, or for mounting a header on an only or uppermost bin.

Referring to FIG. 13, in order to better connect the bin body modules to one another toward their fronts, the outsides of the bottom walls may be provided with screw mounted or molded in place L-shaped clips at the left and right, as at 112, for clipping the left and right margins of the top wall of the lower bin body, near the front, to the bottom wall of the upper bin body. The material of the bin body 18 is sufficiently flexible to permit the necessary temporary deflection to catch the outer legs of the clips under the margin of the notch in the top wall of the lower bin.

Figure 2:
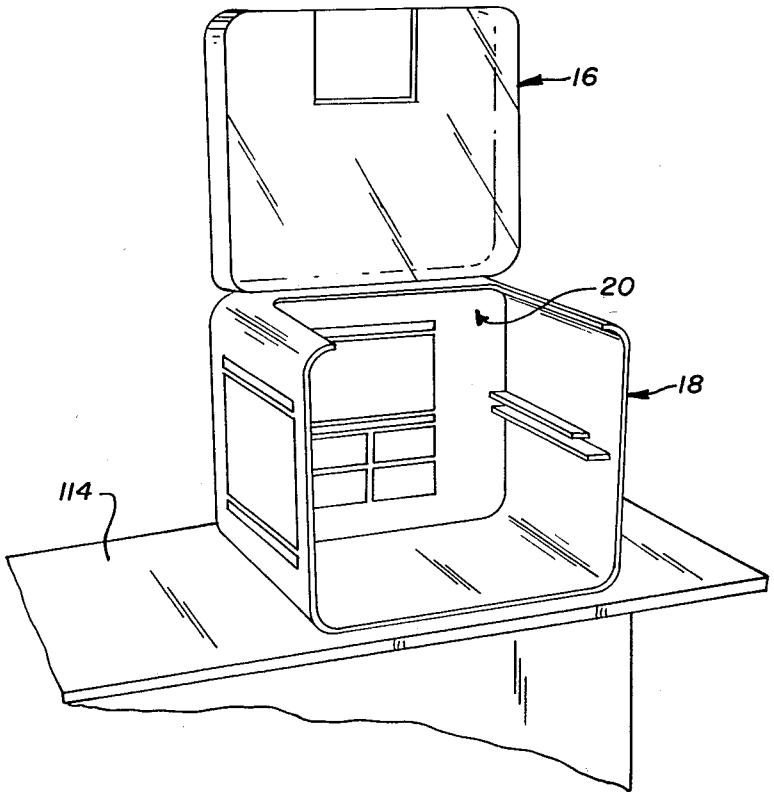
FIG. 2 shows a similar version from which the pedestal has been omitted in favor of simply supporting the bin on a countertop.

FIG. 2 depicts the construction shown in FIG. 1, minus the pedestal. Instead the bin body is simply supported on a countertop 114. This version also could be screwed to a wall, or supported on a wall-attached shelf in an easy-to-understand manner.

FIG. 4 shows a version which differs from that of FIG. 3, but with one more (upper) bin body similarly mounted in place, and with a shorter pedestal.

To reiterate, the header, while shown on the versions of FIGS. 1 and 2 can be similarly used on the versions shown in FIGS. 3 and 4, and, in the same manner that it is shown omitted from the versions shown in FIGS. 3 and 4, it may be omitted from the versions shown in FIGS. 1 and 2.

Although in the description of the assembly, the rods are described as being first mounted to the base and, after the pedestal post is telescoped over the rods, the rods being mounted to the bottom wall of the bin body, in actual practice, a reversal of the order of these assembly steps may be more convenient.

Perhaps needless to state, but if no header or other bin body is to be mounted on a bin body, no posts are installed in the upper slots of that bin body.

As an idea of the scale of the preferred embodiment, the triple bin version shown in FIG. 4 is sized to hold a total of seventy-five copies of a typical day's edition of the USA TODAY newspaper. Perhaps there would be room to pack more in, but at some risk to causing the resulting unit to be tippy or to be subject to too much stress to expect a long life from it.

It should now be apparent that the newspaper vending bin as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A newspaper vending bin for displaying newspapers for self-service free access by prospective readers, comprising:

an open-front box body-like bin comprising a bin body having a back wall integrally joined with an outer peripheral wall including a generally vertical left wall, a generally vertical right wall, a generally horizontal bottom wall and a generally horizontal top wall, adjoining ones of said walls being joined along respective corners; said outer peripheral wall having a front edge which defines a frontal opening into said bin body, said bin body being sized to receive a stack of newspapers resting on said bottom wall, between said left and right walls;

said back wall including at least one pair of laterally spaced rib means extending vertically thereon; for each said pair of rib means, a slot being formed in said top wall at a location disposed between said pair of rib means; a stop web means extending transversally between each rib means of each pair; at least one post extending down through a respective said slot, between two respective rib means and engaged on a respective stop web, leaving a respective stub portion extending up out of the respective said slot; and a second container for removably containing at least one newspaper, said second container comprising a back wall joined with an outer peripheral wall including a generally vertical left wall, a generally vertical right wall and a generally horizontal bottom wall; means defining an opening into said second container so that said at least one newspaper may be inserted in and retrieved from within said second container; said second container having means associated with said back wall securing each said stub portion to said second container with said bottom wall of said second container supported on said top wall of said bin body.

2. The newspaper vending bin of claim 1, wherein:

said second container is a header arranged for receiving a single, folded copy of a newspaper, vertically oriented so that the front page of that newspaper copy is visible, above the fold therein, frontally of said newspaper vending bin.

3. The newspaper vending bin of claim 2, wherein:

said opening defining means of said second container is an upwardly-opening slot; and said second container further includes a glazed front window between said left wall and said right wall of said second container, through which the display copy of the newspaper may be observed.

4. The newspaper vending bin of claim 3, wherein:

said means associated with said back wall for securing each said stub portion to said second container comprises at least one fastener installed through said back wall, the respective said stub portion and into a front wall of said second container, said glazed window being provided in said front wall.

5. The newspaper vending bin of claim 2, wherein:

said rib means are provided on a front surface of said rear wall of said bin body; and said bin further includes a facade-like inner back panel mounted to said back wall frontally of said rib means so as to sandwich said at least one post between said back wall and said inner back panel.

6. The newspaper vending bin of claim 1, wherein:

said rib means are provided on a front surface of said rear wall of said bin body; and said bin further includes a facade-like inner back panel mounted to said back wall frontally of said rib mean so as to sandwich said at least one post between said back wall and said inner back panel.

7. The newspaper vending bin of claim 6, further including:

logography displayed on a front surface of said inner back panel.

8. The newspaper vending bin of claim 6 wherein:

said bottom wall of said second container includes at least one slot formed therethrough, in front of said back wall thereof, each said stub portion being received upwardly through a respective said slot.

9. The newspaper vending bin of claim 6, wherein:

said bottom wall of said second container includes at least one slot formed therethrough, in front of said back wall thereof, each said stub portion being received upwardly through a respective said slot; and said second container is constituted by a second said open-front box body-like bin.

10. The newspaper vending bin of claim 1, further comprising:

a pedestal including a foot having a post extending upwardly therefrom; and means securing said bottom wall of said bin body on said pedestal with said bottom wall of said bin body engaged with an upper end of said post of said pedestal.

11. The newspaper vending bin of claim 1, wherein:

said bin body is integrally molded of structural foam plastic resin.

12. The newspaper vending bin of claim 1, wherein:

said top :wall of said bin body is medially frontally broadly notched, so that said top wall exists as a U-shaped structure bordering a resulting notch, whereby newspapers when stacked in said bin body are visible both frontally and from above.

* * * * *